US007062892B2

(12) United States Patent
Metzger

(10) Patent No.: US 7,062,892 B2
(45) **Date of Patent: *Jun. 20, 2006**

(54) ICE BAGGING APPARATUS AND METHOD

(75) Inventor: Mark C. Metzger, Glendale, AZ (US)

(73) Assignee: Icex Holdings Ltd., Inc., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/990,733

(22) Filed: Nov. 17, 2004

(65) Prior Publication Data

US 2006/0005553 A1 Jan. 12, 2006

Related U.S. Application Data

(63) Continuation-in-part of application No. 10/886,223, filed on Jul. 6, 2004.

(51) Int. Cl.
*B65B 43/00* (2006.01)

(52) U.S. Cl. ..... 53/440; 53/459; 53/127; 53/501; 53/570

(58) Field of Classification Search ..... 53/440, 53/459, 127, 501, 570
See application file for complete search history.

(56) References Cited

U.S. PATENT DOCUMENTS 2,116,300 A * 5/1938 Campos ..... 141/369
2,584,726 A * 2/1952 McOmber ..... 222/306
4,013,199 A * 3/1977 Brown ..... 222/438
4,689,937 A * 9/1987 Finan et al. ..... 53/502
5,088,300 A * 2/1992 Wessa ..... 62/340
5,277,016 A * 1/1994 Williams et al. ..... 53/459
5,473,865 A * 12/1995 Tanaka et al. ..... 53/502
5,630,310 A * 5/1997 Chadwell ..... 53/502
6,112,539 A * 9/2000 Colberg ..... 62/331
6,827,529 B1 * 12/2004 Berge et al. ..... 406/28
6,904,946 B1 * 6/2005 James ..... 141/313

* cited by examiner

*Primary Examiner*—John Sipos
*Assistant Examiner*—Michelle Lopez
(74) *Attorney, Agent, or Firm*—The Matthews Firm

(57) ABSTRACT

An apparatus and method for bagging ice. The apparatus comprises an ice maker for making ice and a hopper for receiving for receiving the ice from the ice maker. The apparatus further includes a roller drum, operatively associated with the hopper, for measuring the ice and delivering of the ice. The roller drum includes an inner rotating drum. A bag delivery mechanism for placing the ice in a bag is also included, with the bag delivery mechanism including a bag supply mechanism, a fan engaged to open the mouth of the bag to receive the product, and a heat sealer that seals the open mouth of the bag once the bag is filled with the ice. A control device is included that manages and monitors the roller drum and bag delivery mechanism and allows transmission of the collected data to the Internet.

22 Claims, 13 Drawing Sheets

ICE BAGGING APPARATUS AND METHOD

This application is a continuation-in-part application of my co-pending application bearing Ser. No. 10/886,223, which was filed on 6 Jul. 2004.

BACKGROUND OF THE INVENTION

This invention relates to an ice bagging apparatus. More specifically, but not by way of limitation, this invention relates to an ice bagging apparatus, method of using the apparatus, and the process of remotely monitoring the apparatus from a remote location.

The production of ice for consumer consumption is a major industry. Consumers require ice for drinks, ice chest, refrigeration, etc. Typical ice production requires the use of an ice maker that deposes of the ice into bags. The bags of ice are then stacked into a freezer. The bags can then be retrieved from the freezer by users.

In the retail business, many times the bags of ice are delivered to the store site. A freezer, located at the retail business, will store the bags of ice. Hence, theses prior art devices require that the ice maker and the dispenser (freezer) be separate. The separation of the ice maker and freezer leads to many problems, including but not limited to transportation, inadequate inventory, time delivery problems, etc.

Some prior art devices have attempted to locate the ice maker and the dispenser in one unit and wherein the dispenser is located at the retail site. However, these prior art devices have had many problems. For instance, if the device is in a retail establishment and the device develops a problem, the employees of the retail establishment have no expertise in repairing the device. Additionally, these prior art devices have been unreliable in their attempt to automate the process due to the numerous cooperating components. For instance, during the bagging process, the ice can bridge thereby effectively halting the placement of ice into the bags. Therefore, there is a need for a device that can produce and dispense of the ice in a single unit. There is also a need for an apparatus that can operate autonomously. Additionally, there is a need for a device that will collect information regarding the production of ice, and reliably store and report that information to a remote location. These needs, as well as many others, will be met by the herein described invention.

SUMMARY OF INVENTION

Briefly described, in a preferred embodiment, the present invention overcomes the above-mentioned disadvantages and meets the recognized need for such a device by providing an ice-bagging apparatus and method that provides an establishment with the ability to automatically and expeditiously produce, bag and store bags of ice, thus maintaining a desired supply of bagged ice by eliminating conventional methods of manual ice bagging and reducing the likelihood of unwanted bridging of the ice particles/cubes.

According to its major aspects and broadly stated, the present invention in its preferred form is an ice-bagging apparatus having an ice maker and a hopper for receiving ice from the ice maker. A roller drum measuring and delivery system, a bagging mechanism for bagging the ice, a freezer for storing the bagged ice and a control panel for managing and monitoring the system is included.

More specifically, the present invention is an ice bagging apparatus having an ice maker, a hopper for receiving ice from the ice maker, a roller drum means that measures the amount of ice to be bagged and delivers the ice to the opened bag wherein the bag is fed through the apparatus via a bag supply mechanism. The roller drum means includes an outer drum and an inner rotating drum. Once the roller drum is filled with the desired amount of ice, the roller drum rotates through a computer programmed/electronically controlled position so that ice within the drum is allowed to fall into a bag. A blower fan is engaged to open the mouth of the bag to receive the ice. The ice is then dumped into the waiting bag. The filled bag is then heat sealed using a heat seal strip. The sealed bag is then rotated out of the heat seal operation and dumped into a freezer/storage unit. The entire process is fully automated and/or computer controlled.

The invention possesses laser switch means positioned at specific areas on the machine for reading the process at various stages to properly time the sequence of operation. A scanner means is used to read a signal code on the furnished bags ensuring only a select type of bag /brand can be used, to count the number of bags, etc.

If the equipment encounters a problem, the electronics provided with the equipment will attempt to correct the problem. If the electronics provided cannot correct the problem, a signal is sent via a telecommunication means to a web site for assistance in repairing the malfunction. This web site also gathers information such as number of bags utilized, number of cycles or volume of ice produced.

In one preferred embodiment, a process of bagging ice with an ice bagging apparatus is disclosed. The process comprises making ice and channeling the ice to a hopper then to a roller drum means. Next, the amount of ice is measured in the roller drum means and a bag is supplied via a bag supply mechanism. The roller drum means contains an inner rotating drum that is concentrically disposed within an outer drum. An open mouth of the bag is engaged with a blower fan and the bag is blown open with the blower fan. The process includes rotating the inner rotating drum so that an opening in the inner rotating drum is aligned with a bottom opening in the outer drum so that the ice within the drum means may be delivered to the opened bag, and the bag can be filled with the desired amount of ice. The number of rotations of the inner rotating drum can be controlled by a control means, and the number is recorded. After the desired amount of ice has been deposited within the opened bag, the bag is heat sealed with a heat seal strip and cut. The sealed bag is rotated into a freezer/storage unit.

The process may further include placing a plurality of laser switches at specific areas on the apparatus for reading the process at various stages to properly time the sequence of operation, and placing reading means to read a signal code on the furnished bags from the bag supply mechanism in the ice bagging apparatus and transmitting the information to a control means, the control means being operatively associated with the ice bagging apparatus, and storing the information obtained from the laser switches and reading means within the control means. Next, the information is transmitted to a web page accessible on the Internet and remote users may monitor the information found on the web page for ensuring production of ice bags, for reporting, and for regular maintenance.

An advantage of the invention is its ability to continuously and automatically produce bags of ice, thus maintaining a desired supply of bagged ice. Another advantage is that the apparatus has the ability to send and receive computer signals for regular maintenance and reporting. Yet another advantage is that the equipment drains water as it is produced from the ice maker to eliminate the potential problem of bridged ice in the bagging process. Another advantage is that the equipment functions without the use of augers as utilized in prior art machines. The apparatus eliminates the possibility of bridged ice and increases production rates.

Yet another advantage is that the apparatus and process will reduce a vendor's overall cost of bagged ice. Still yet another advantage is the apparatus' electronic ability to attempt to correct problems associated with its components and/or machine parts via preprogramming the control means to manipulate the various motors and sensors. If the problems cannot be corrected internally, a signal is sent for further assistance in remedying the problem through its global networking system.

A feature of the invention is that the apparatus has the ability to police the selection and brand of bag being used. If the particular bag being used is not approved, the machine will not function. Another feature is that the apparatus is designed to utilize less space than prior art machines giving customers more costly floor space in their stores for displaying other merchandise. Another feature is that the apparatus has the ability to open mechanically a bag during the process of filling with ice. Still yet another feature is the ability to agitate ice held in the hopper prior to bag filling to eliminate the possibility of bridging.

Another feature is use of the rotating drum. Yet another feature is the amount of ice delivered into the bag can be measured via counting the number of rotations of the drum drive motor. Still yet another feature is that by measuring the number of revolutions of the rotating drum, the amount of ice delivered to a waiting bag can be calculated.

These and other objects, features and advantages of the present invention will become more apparent from the above description and claims when read in light of the accompanying drawings.

DETAILED DESCRIPTION OF THE PREFERRED EMBODIMENTS

Figure 1:
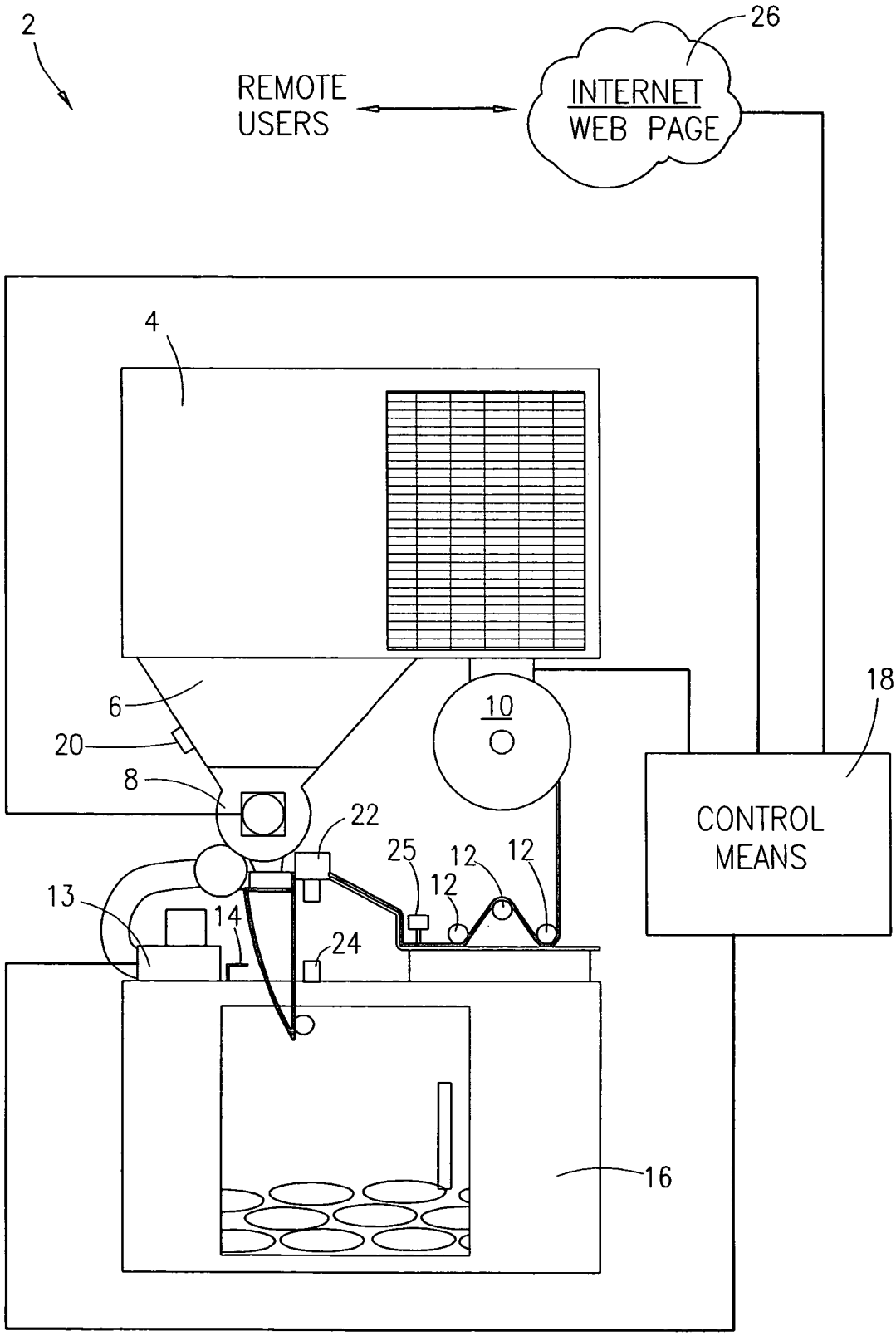
FIG. 1 is a schematic illustration of a first ice bagging apparatus and system embodiment.

Referring now to FIG. 1, a schematic illustration of one embodiment of the ice bagging apparatus and system 2 will now be described. The apparatus 2 includes an ice maker 4 for making ice, and wherein the ice maker 4 will be operatively associated with a hopper 6 for receiving the ice from the ice maker. A roller drum means 8 operatively associated with the hopper 6, for measuring ice and delivering of the ice is included.

The apparatus 2 also includes a bagging means, operatively receiving the ice from the roller drum means, for placing the ice in a bag. The bagging means includes a bag supply mechanism that includes a cylinder 10 containing rolled up plastic bags, a roller bar system, seen generally at 12, that are used for advancing the bags from the cylinder 10, a blower fan 13 engaged to open the mouth of the bag to receive the product, and a heat sealer means 14 for heat sealing the open mouth of the bag once the bag is filled with the ice.

The apparatus 2 further contains a freezer 16 for storing the bagged ice, so that after the ice is dumped into the opened ice bag, and then heat sealed, the bag is then cut and placed into the freezer 16. FIG. 1 further depicts control means 18 for managing and monitoring the roller drum means 8, the cylinder 10, and the bagging means.

In one preferred embodiment, the apparatus 2 includes laser switches, seen generally at 20, 22, 24 for reading the process at various stages to properly time the sequence of operation of the ice bagging. For instance, the laser switch 20 determines the amount of ice in the hopper. The laser switch 22 determines the basket's position. The laser switch 24 determines whether the bag has been cut and severed. The information collected via the laser switches is sent to the control means 18 for storage and processing. Also, the bags may include a signal code containing identifying information and wherein the apparatus further includes means for reading the signal code on the bag ensuring only a select type of bag can be used, and sending that information to the control means. The reading means can be a scanner device 25, and wherein the scanner device is commercially available from Automated Packaging Inc. under the name Auto-Bag.

In the preferred embodiment, the control means 18 further comprises means for storing the information obtained from the laser switches, sensor means and reading means is provided, and wherein the storing means is operatively associated with the control means, and means for transmitting the information to a web page accessible on the Internet 26. Hence, remote users can then log onto the Internet, and monitor the entire ice making, bagging and distribution. The remote users can also attempt to trouble shoot problems based on the diagnostic data that has been collected via the control means 18 by transmitting digital instructions to the various motors and sensors.

Figure 2:
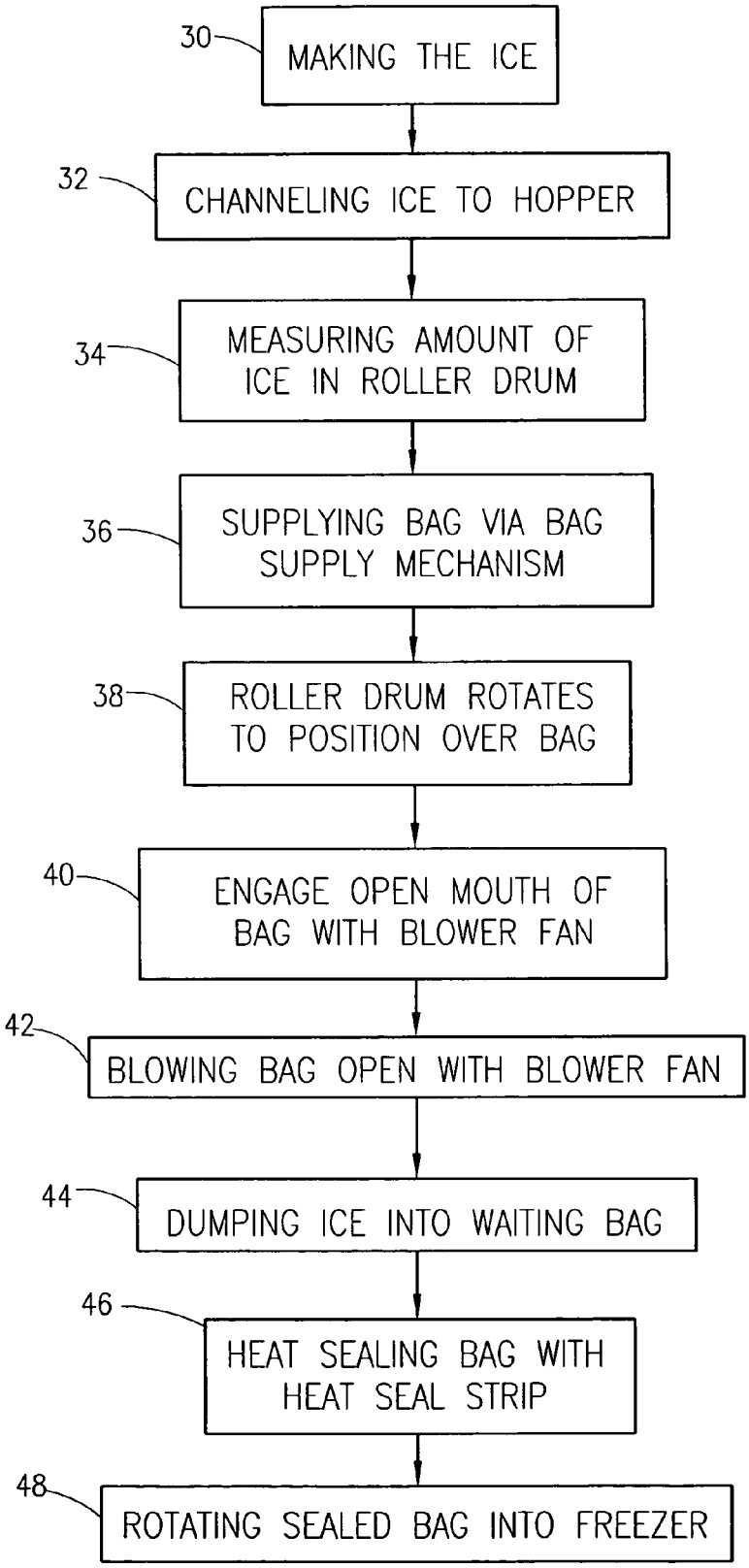
FIG. 2 is a flow chart of the ice bagging process of the first embodiment.

Referring now to FIG. 2, a flow chart of the ice bagging process of the first embodiment will now be described. First, ice is made with the ice maker (step 30), and then ice is channeled to the hopper (step 32). The amount of ice is measured in the roller drum (step 34). A bag is then supplied via a bag supply mechanism (step 36). Once the roller drum is filled with an amount of ice, the roller drum rotates to position over the bag (step 38). Next, an open mouth of the bag is engaged with a blower fan (step 40), and the bag is blown open with the blower fan 42. The ice is dumped into the waiting bag (step 44) and then the bag is heat sealed with a heat seal strip (step 46). Next, the sealed bag is rotated into a freezer/storage unit (step 48).

Figure 3:
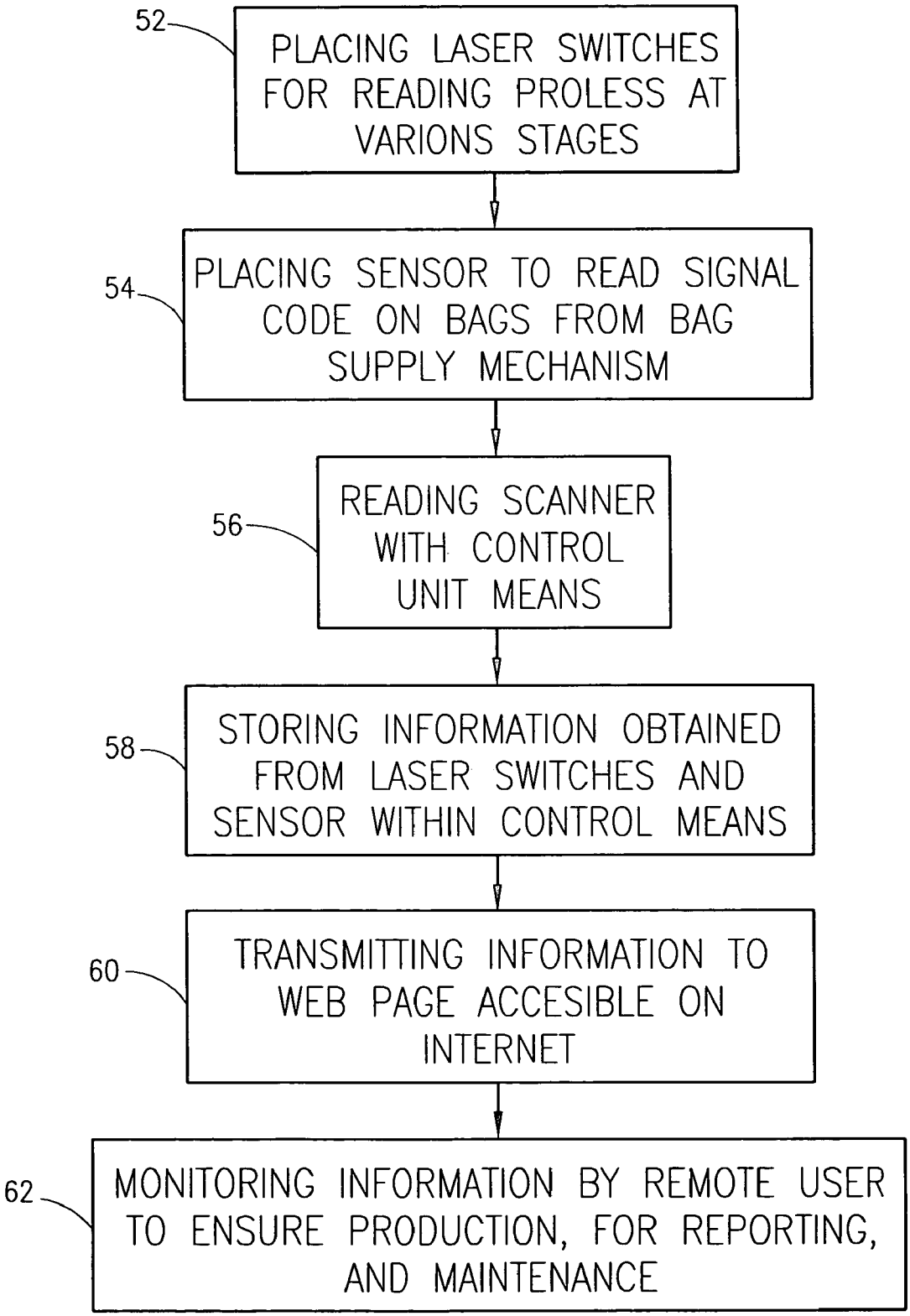
FIG. 3 is a flow chart of the control unit operation and process of the first embodiment.

FIG. 3 is a flow chart of the control means operation and process of the first embodiment. The process includes placing laser switches at specific areas for reading the process at various stages to properly time the sequence of operation (step 52), and scanner means to read a signal code on the furnished bags from the bag supply mechanism (step 54). The process further includes reading the scanner means with the control unit means, located on the apparatus (step 56) and storing the information obtained from the laser switches and scanner means within the control means (step 58). Next, the process includes transmitting the information to a web page accessible on the Internet (step 60) and monitoring the information found on the web page by a remote user to ensure production of ice bags, for reporting, and regular maintenance (step 62).

Figure 4:
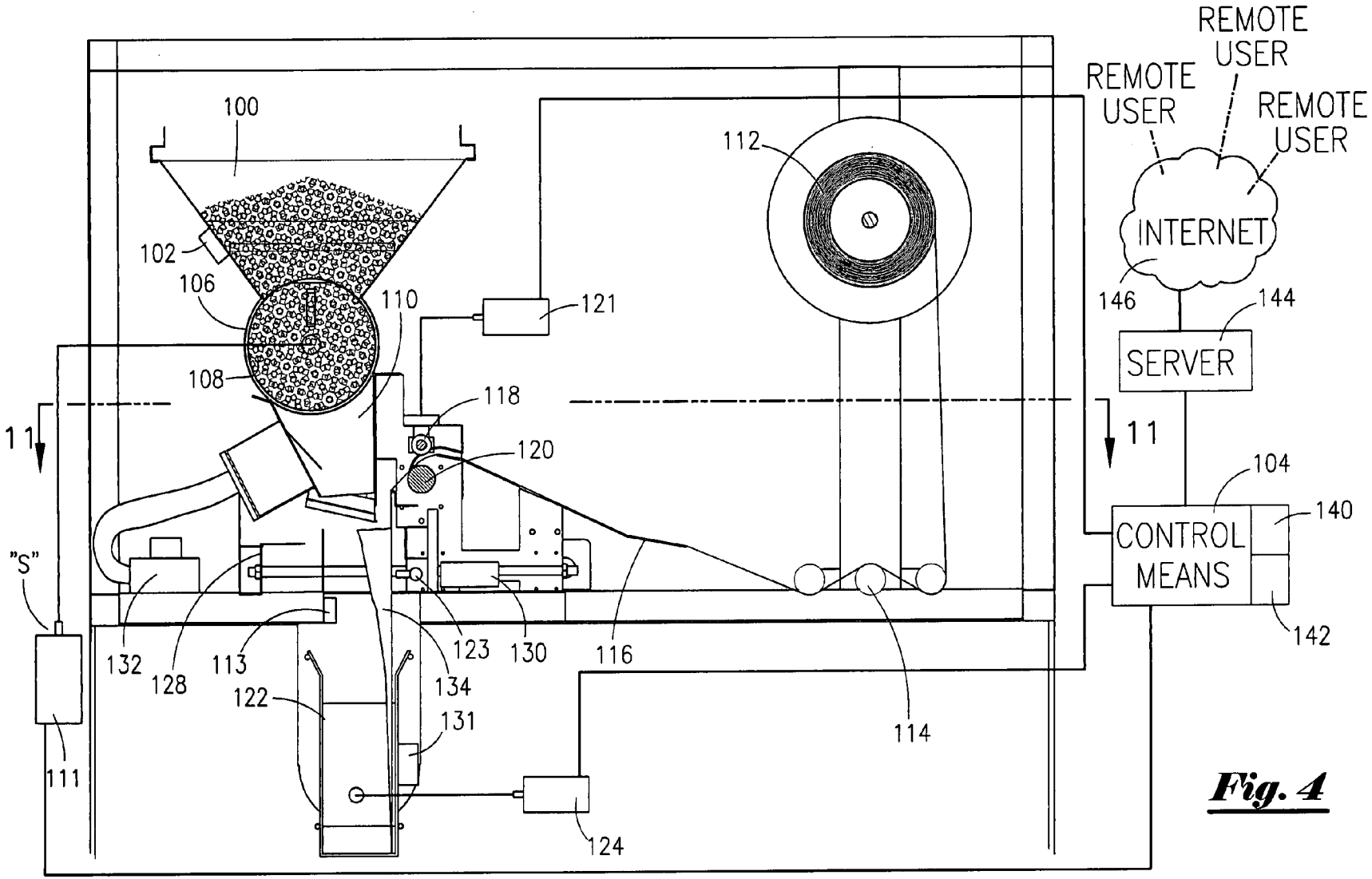
FIG. 4 is a schematic illustration of the most preferred embodiment of the present ice bagging apparatus and system.

Referring now to FIG. 4, a schematic illustration of the most preferred embodiment of the present ice bagging apparatus and system will now be described. It should be noted that like numbers appearing in the various figures refer to like components. FIG. 4 depicts the hopper 100, wherein the hopper is made of food grade stainless steel. The hopper 100 has associated therewith a hopper sensor 102, and wherein the hopper sensor is commercially available from Omron Corporation under the name E3Z-B62 (Emitter). This sensor 102 is a photo cell with laser, wherein the cell is at the front part of the hopper and the reflector being on the back side of the hopper. The sensor 102 senses, via the laser beam, when the hopper has sufficient ice to fill an open bag. The sensor 102 signals the control means 104 (sometimes referred to as the control panel 104). If ice is present, it sends a signal to the control means 104 that ice is present and is ready for bagging. The sensor is mounted on the hopper 100 and in electrical communication with the control panel 104.

The system further contains a drum means for collecting and dispensing the ice. The drum means includes an outer drum 106 and an inner rotating drum 108, wherein the outer drum 106 has a top and bottom rectangular opening disposed therein. The inner drum 108 slides into the outer shell 106, and wherein the inner drum 108 contains an opening. The bottom opening of the outer drum 106 is operatively fitted with a chute 110 leading to the bag opening. The inner drum 108 has a digital rotator motor 111 which is controlled by a software program, wherein the software program is operatively associated with the control panel 104, with the software program telling the motor the number of revolutions it needs to make to dump ice into the bag chute. The digital rotator motor 111 is commercially available from Oriental Corporation under the name FPW425A-180LL. After dumping of ice is completed, the motor 111 is then told to return to the home position ready to fill again and continue with the same function of filling the bag with the desired weight of ice cubes. The number of rotations the drum is programmed to make is based on the size of the bag being filled. For example, a seven pound bag of ice needs to dump twice; a ten pound of bag is required to dump three times. The number of rotations of the drum can be calculated by counting the number of rotations of the motor shaft "S", wherein the motor shaft "S" is connected to the inner drum 108.

The embodiment of FIG. 4 also depicts the bag delivery system. The ice bags are placed on the roll 112. When the bags are on the roll, the bags consist of a continuous extruded tubular enclosure. The bags are pre-perforated to specific measurements. The bags may also contain digitally coded information that can be read by, for instance, a scanner means 113 for reading information which can then be relayed to the control panel 104 for processing and storage. The digitally coded information may be in the form of a bar code. The information on the bag may include the bag number, bag type, bag name, etc. The scanner means 113 is commercially available from Automated Packing Inc. under the name Auto Bag.

The bags are filled with ice prior to heat sealing, and the proper amount of ice cubes will be placed into the waiting bag via the inner rotating drum 108. From the roll 112, the bags are led to the idle rollers 114. The idle rollers 114 stretch out the bags and hold resistance on them while being fed into the ready position. In turn, the bag guide 116 guides the bags into the feed roller 118. The feed roller 118 is operatively associated with the roller 120 that has operatively connected a stepper type of motor 121. The stepper motor is commercially available from Oriental Corporation under the name PK594NAWA-A2.

The stepper feed motor 121 for roller 120 is a digital motor that is controlled via preprogrammed instructions, and wherein the stepper feed motor 121 for roller 120 is operatively connected to the control panel 104 so that the instructions can be signaled to the stepper feed motor 121, and information can in turn be sent back to the control panel 104 for processing and storage and transmission. The rotation of the motor 121 for roller 120 is dictated by the bag position within the bag basket 122. The bag basket 122 is constructed of stainless steel in the most preferred embodiment. The position is detected by the bag bottom sensor 123, and that positional information signal is relayed to the control means 104. In effect, the bags are told to move and stop. As seen in FIG. 4, the rollers 118, 120 are mounted top and bottom, and pull the bags into the staging area of the bagger. The sensor 123 is commercially available from Omron Corporation under the name E3Z-B61 and encompasses photocell and digital technology. The sensor 123 is set to read the perforation on the bag in that the laser shines through the perforations. The position of the bag is controlled by the bag bottom sensor 123.

Once it has been indicated that the bag has filled with ice, the bag can be sealed and cut. The heat seal bar and the bag cutter means is seen generally at 128. The heat seal bar and cutter means 128 has a heat strip attached to it and is moved with an analog motor (seen at 130) which provides for lateral movement of the heat sealer and cutter. The motor 130 is located under the slide area and is driven by gears and limit switches to control the pulses the unit goes through while sealing the bag and controlled with micro switches. The heat seal strip is controlled with a thermostat and is approximately 250 degrees Fahrenheit. The heat seal bar is pulsed with current approximately three times, in the most preferred embodiment, to get a good bag seal. The bag is cut with the cutters on the heat seal bar and cutter means 128, and wherein the bag falls into the basket 122. The bag can be rotated out of the basket 122.

The bag basket will rotate in order to dump a filled bag of ice after the bag has been cut with cutters on the heat seal and cutter means 128. The sensor 131 controls the rotation of the holding basket. Sensor 131 is commercially available from Omron Corp. under the name E3Z-B62. It makes the basket return to its home position. The laser type sensor 131 is mounted within the bag basket 122. The sensor 131 is controlled with software that determines the timing for rotation. Sensor 131 makes the holding basket 122 return to the home position after the dumping process occurs.

As seen in FIG. 4, the specific bag is contained within the bag basket 122. The bag basket 122 holds the bag while being filled. There is a rotator motor 124 commercially available from Oriental Corporation under the name FPW 425A-180U attached to the basket which rotates the filled bag of ice out into the freezer after it has been filled, sealed and cut. The bag basket 122 is operatively associated with the basket rotator motor 124. This motor 124 is controlled by the basket rotator sensor 131 mounted on the motor brackets which starts and rotates the motor to its home position after dumping occurs.

A blower fan 132 is included that activates so that the top of the bag opens. Hence, FIG. 4 depicts the situation wherein an individual bag 134 has advanced to a position within the basket 122. The blower fan 132 is connected to chute 110. FIG. 4 depicts the individual bag 134, which was unfurled from the roll 112, advanced into the basket 122. Ice is seen in the hopper 100 as well as within the inner drum 108.

As noted earlier, all of the various sensors are continually gathering information. This information is being sent to and stored within the control means 104, and in particular within a computer means 140. The computer means 140 will store and process the information. Pursuant to a predetermined transmission schedule, the communication module 142 will periodically transmit certain gathered information to a central server 144. The transmission link may be wireless, hardwired or a satellite frequency signal. From this central server 144, remote users can access the information for monitoring. In the most preferred embodiment, and as seen in FIG. 4, the central server 144 may in turn be connected to the Internet 146. Additionally, certain remote users will have the ability to communicate with the ice bagging apparatus 2 by transmitting a signal via the central server 144 link that will be received by the communication module 142, and in turn download the files to the computer means 140. Thus, it is possible to download software, which could include instructions to make the apparatus 2 perform a special operation such as polling a sensor mounted to the motor 111 in order to determine the number of rotations of the motor 111 shaft which in turn established the amount of ice dumped to the bags.

Figure 5:
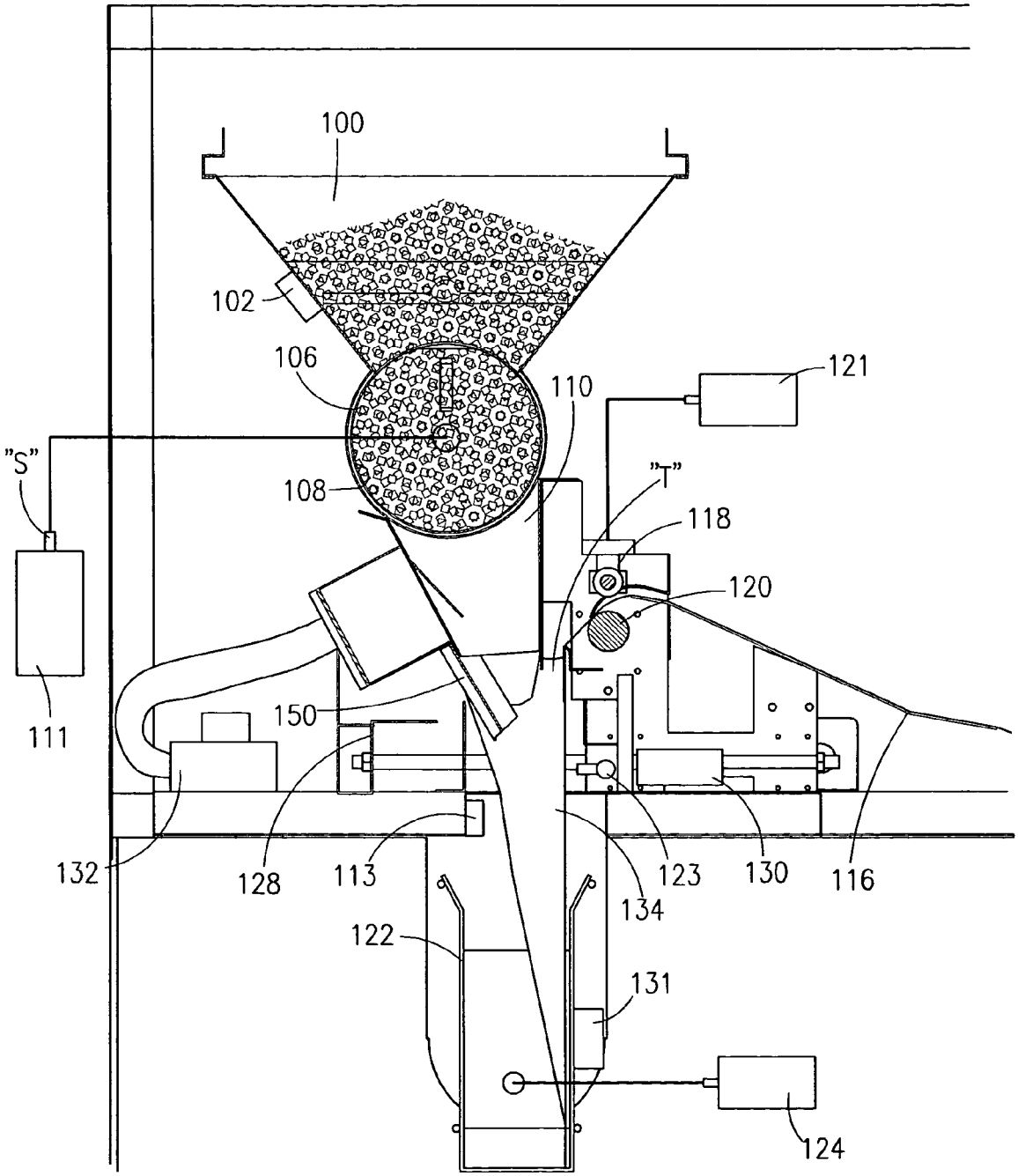
FIG. 5 is the schematic illustration of the embodiment of FIG. 4 showing the sequence of the ice bag being blown open.

FIGS. 5 through 9 show the sequence of operation of the apparatus 2. FIG. 5 depicts the schematic sequence illustration of the embodiment of FIG. 4 showing that the top "T" of the bag 134 has been blown open via activation of the blower 132. Once the top "T" is opened, the holding plate 150 can swing open thereby keeping the top "T" of the bag open for the delivery of the ice, as will be more fully explained.

Figure 6:
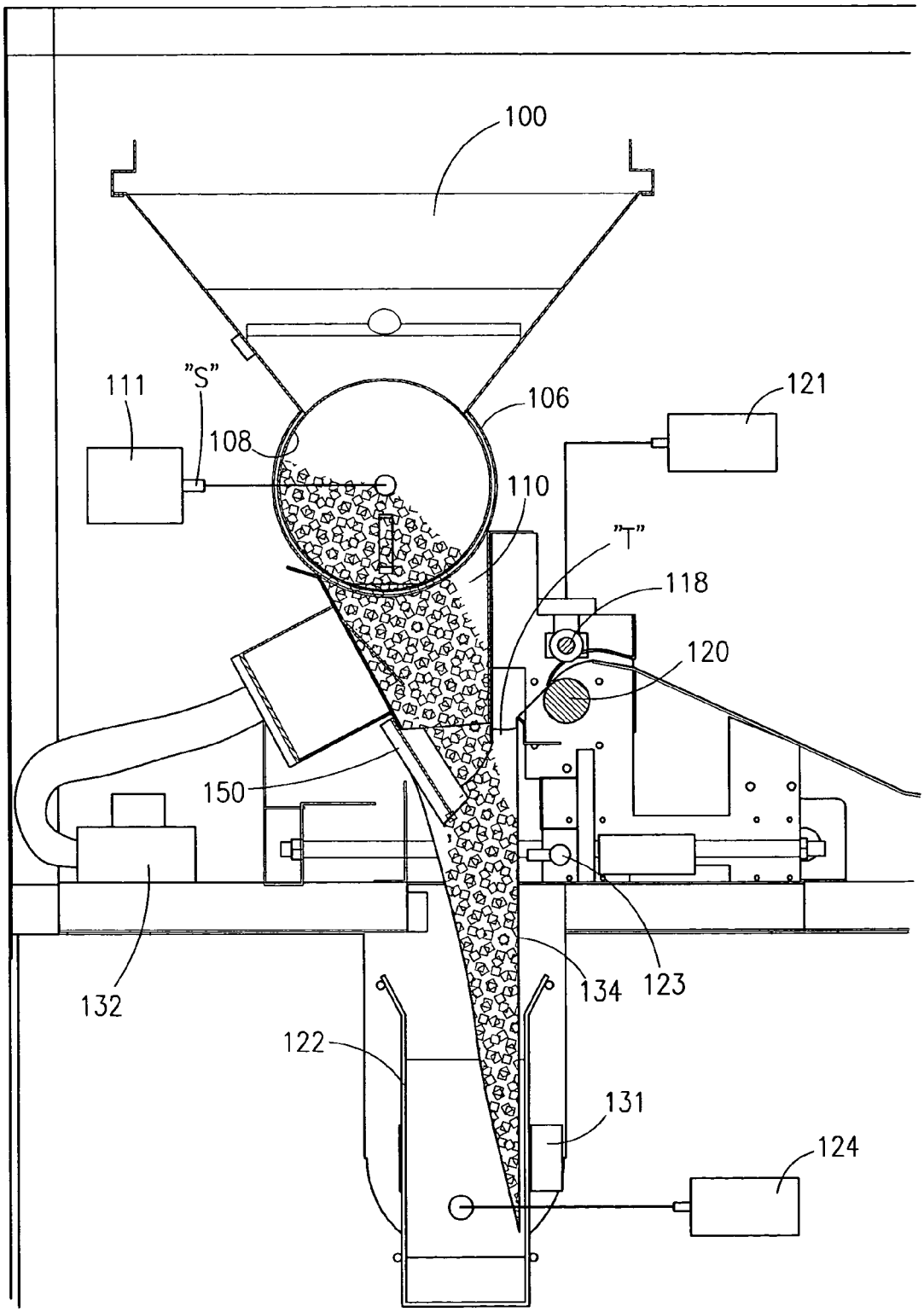
FIG. 6 is the schematic illustration of the embodiment of FIG. 4 showing the sequence of channeling ice into the ice bag.

Referring now to FIG. 6, a schematic illustration of the embodiment of FIG. 5 showing the sequence of channeling ice into the ice bag 134 will now be described. The ice is being dumped into the open bag 134 via the inner rotating drum 108 having been rotated so that the opening of the inner rotating drum 108 and the bottom opening in the outer drum 106 align. Once the openings of the drums are in the aligned position, the ice is funneled down chute 110, through bag top "T", and in turn into the bag 134. Note that a portion of the drum means is empty, while some ice is accumulating on the top of the inner drum 108 since inner drum 108 is closed relative to hopper 100. This ensures that a known and certain volume of ice is placed into the waiting bag. In some cases, multiple cycles (filling and emptying of the drum) may be required. For instance, a small bag may require a single cycle, a medium bag two cycles, and a large bag three cycles. In accordance with the teachings of the present invention, the apparatus can be used with all of these types of bags; the operator can simply reprogram control means 104 to signal the motor 111 as to the proper number of shaft rotations for proper cycling.

Figure 7:
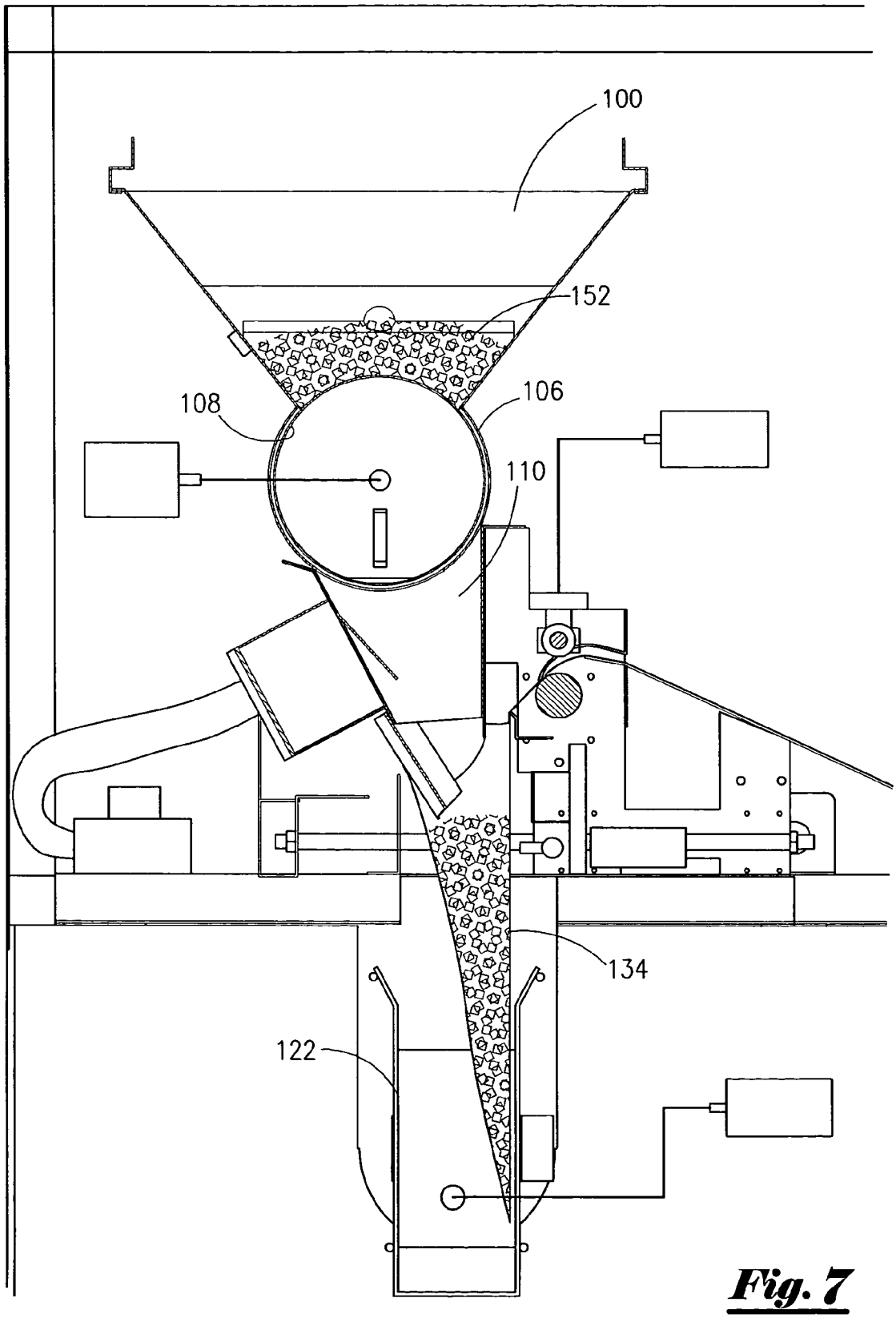
FIG. 7 is the schematic illustration of the embodiment of FIG. 4 showing the sequence of the drum means having allowed the ice to fall into the bag.

FIG. 7 is the schematic illustration of the preferred embodiment of FIG. 4 showing the sequence of the drum means having allowed the ice to fall into the bag 134. As noted earlier, the outer drum 106 contains a bottom opening and the inner drum 108 contains an opening. Rotation of the inner drum 108 will align the openings thereby allowing dumping. However, this means that ice that has accumulated within the hopper 100 will be prevented from entering the inner drum 108. Hence, FIG. 7 depicts the sequence were ice is building up on the top side 152 of the inner drum 108.

Figure 8:
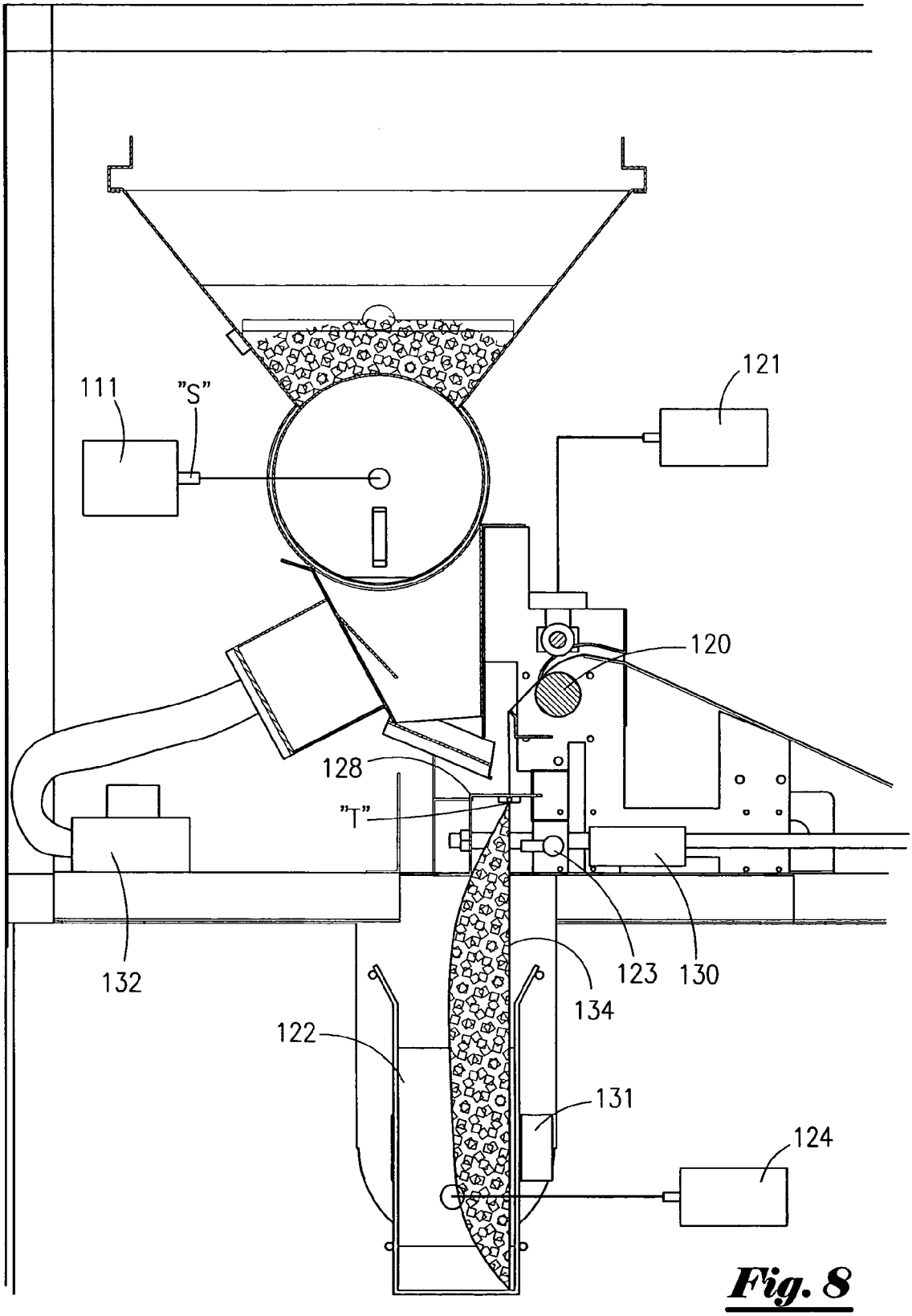
FIG. 8 is the schematic illustration of the embodiment of FIG. 4 showing the bag being cut and heat sealed.

Referring now to FIG. 8, the schematic sequence of the embodiment of FIG. 4 is illustrated showing the bag 134 being cut and heat sealed. More specifically, the heat seal bar and bag cutter means 128 has been moved via motor 130 laterally into contact with the top "T" of the bag 134. The motor 130 is located under the slides with a gear driving the heat seal bar to pulse the correct amount of times to seal the bag. The motor 130 is connected to limit switches to operate the motor sequence. Hence, the bag will be cut and heat sealed thereby providing a closed container. Upon the completion of the sealing sequence, the same limit switches send a signal to the controller to rotate the bag out of the basket 122.

Figure 9:
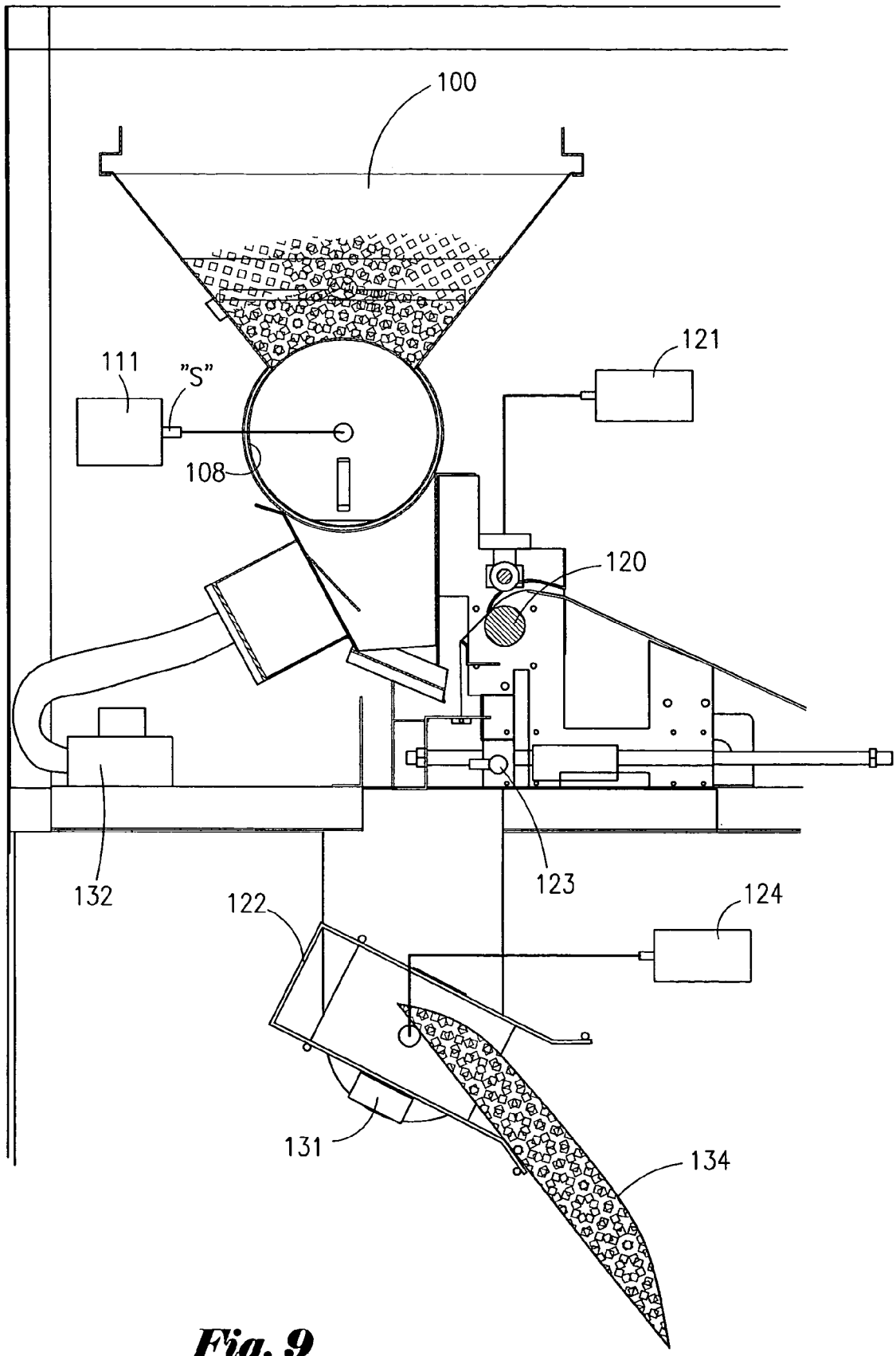
FIG. 9 is the schematic illustration of the embodiment of FIG. 4 showing the bag being rotated out of the basket.

In FIG. 9, the schematic illustrates the next sequence of the bag 134 being rotated out of the basket 122. This is performed via the basket rotor motor 124, whereby the bag is dumped into the freezer for storage. Once the basket 122 is empty, the sensor 131 in the bag basket 122 will indicate that the basket 122 is ready to be rotated back to its upright, home position.

Figure 10:
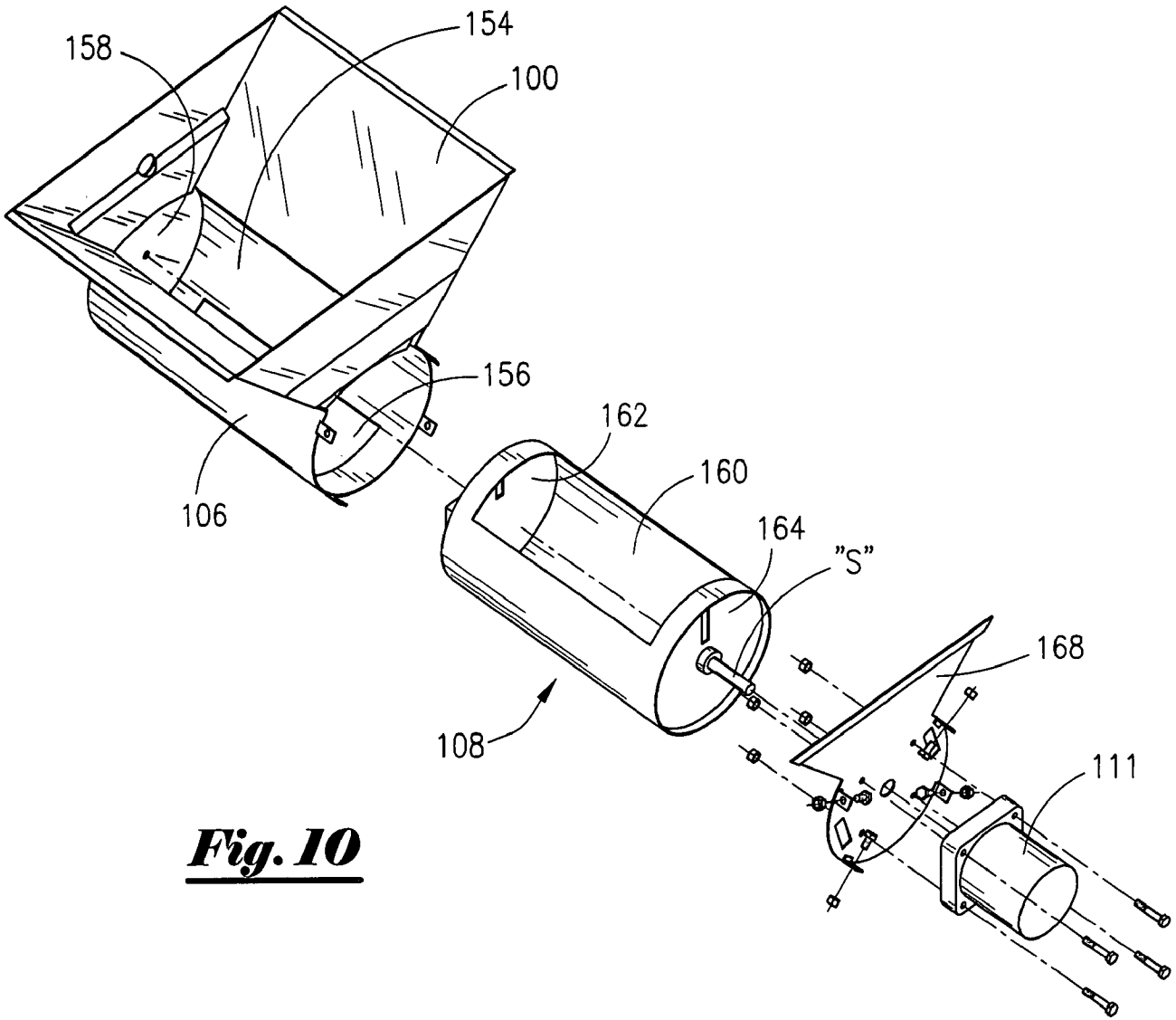
FIG. 10 is a disassembled view of the preferred embodiment of the drum means.

A disassembled view of the preferred embodiment of the drum means is illustrated in FIG. 10. The outer drum 106 is cylindrical having a generally rectangular top opening denoted by the numeral 154, and a bottom opening denoted by the numeral 156. The top portion of the outer drum is connected to the hopper 100, and receives the ice from the hopper 100 via opening 154. The outer drum 106 has a side wall 158. The inner rotating drum 108 will be rotatably disposed within the outer drum 106. The inner rotating drum 108 has the generally rectangular opening 160, and two side walls 162, 164. The shaft "S" is attached to the side wall 164. A mounting plate 168 secures to the hopper 100 and the outer drum 106. FIG. 10 depicts a motor means 111 for rotating the shaft 166 which in turn rotates the inner rotating drum 108. A plurality of securing means, such as nuts and bolts, are also shown in FIG. 10.

Rotation of the shaft "S" via motor 111 will cause the opening 160 to align with the opening 156 so that ice within the hopper 100 can be dumped into the bags, as previously discussed. The amount dumped will be the volume of the drum means, and in particular the inner drum 108. As noted earlier, the motor 111 is operatively connected to the control panel 104 so that the number of rotations of the shaft "S" can be controlled and counted. For instance, a complete rotation of the shaft "S" will dump the known volume once. In this way, the operator can keep track of the amount of ice dumped by counting the number of rotations of the shaft. Hence, in a preferred embodiment, two rotations of the shaft may be desired per cycle, and wherein a cycle is defined as the filling and dumping the drum means into an individual bag. The operator can change the number of rotations desired per bag, which in turn changes the amount of ice dumped into the waiting bag.

Figure 11:
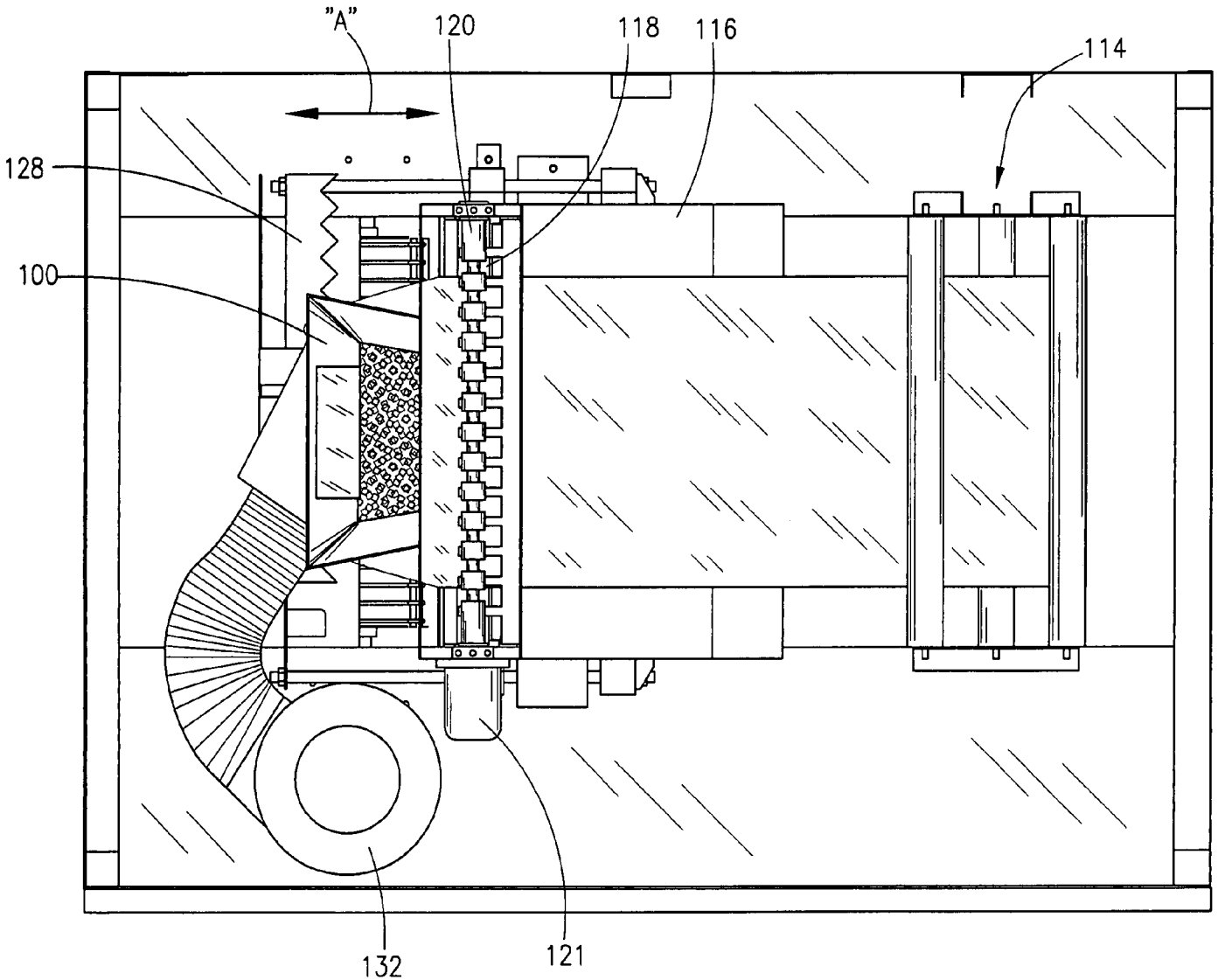
FIG. 11 is a cross-sectional view of the apparatus taken along line 11—11 of FIG. 4.

FIG. 11 is a cross-sectional view of the apparatus taken along line 11—11 of FIG. 4. FIG. 11 depicts the idle rollers 114 as well as the bags from the bag roll positioned on the bag guide 116. The bags cooperate with the feed rollers 118, 120, and will be advanced via stepper motor 121, as previously noted. FIG. 11 also shows the heat seal bar and bag cutter 128, as well as the blower fan 132. As noted earlier, the heat seal bar and bag cutter 128 travels laterally back and forth, as denoted by the arrow "A".

Figure 12:
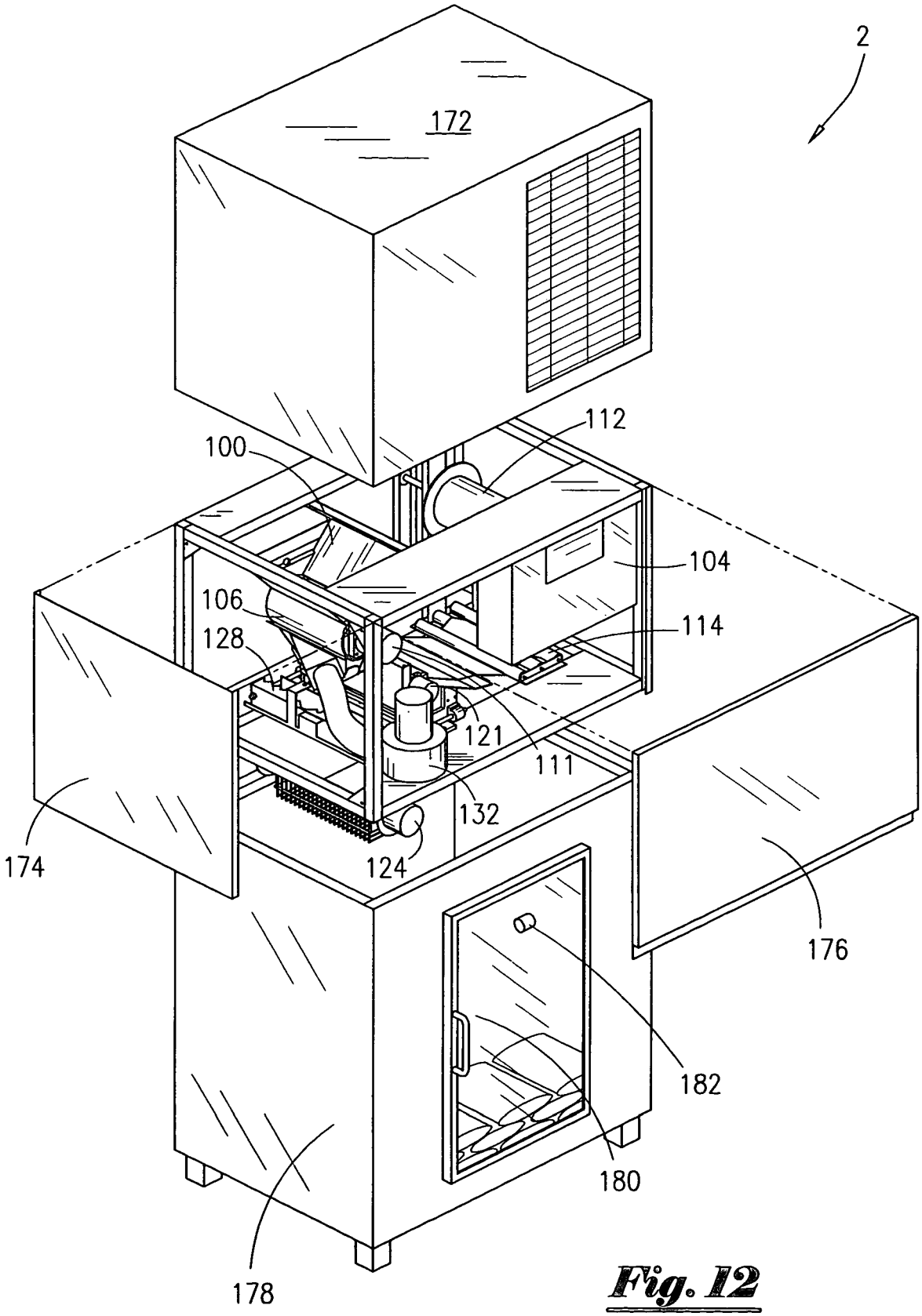
FIG. 12 is a perspective view of the apparatus seen in FIGS. 4 through 11.

Referring now to FIG. 12, a perspective view of the apparatus 2 seen in FIG. 4 will now be described. An ice maker means 172 for making ice is shown positioned above the hopper 100. FIG. 12 also shows the panels 174, 176 being removed so that the bag roll 112, idle rollers 114, outer drum 106, and motor 111 is shown. The previously described control means 104 is also shown. FIG. 12 also shows the heat seal bar and bag cutter 128, the blower fan 132 and stepper motor 121. Once the ice is bagged, sealed and cut as previously described, the bag will be delivered into the freezer 178 where a consumer can simply open the door 180 and retrieve the desired number of bags of ice. It is possible to have a sensor mounted in the door and operatively connected to the control means 104 to determine if the door is open or closed. Also, a merchandiser sensor 182 may be located within the freezer and determines whether the bags of ice are stacked to a predetermined level i.e. the merchandiser (freezer) is full. The merchandiser sensor 182 may be a laser switch with reflector in one preferred embodiment. The apparatus 2 can be conveniently placed within stores, restaurants, gas stations, etc. and be autonomously monitored and controlled, as previously set out.

Figure 13:
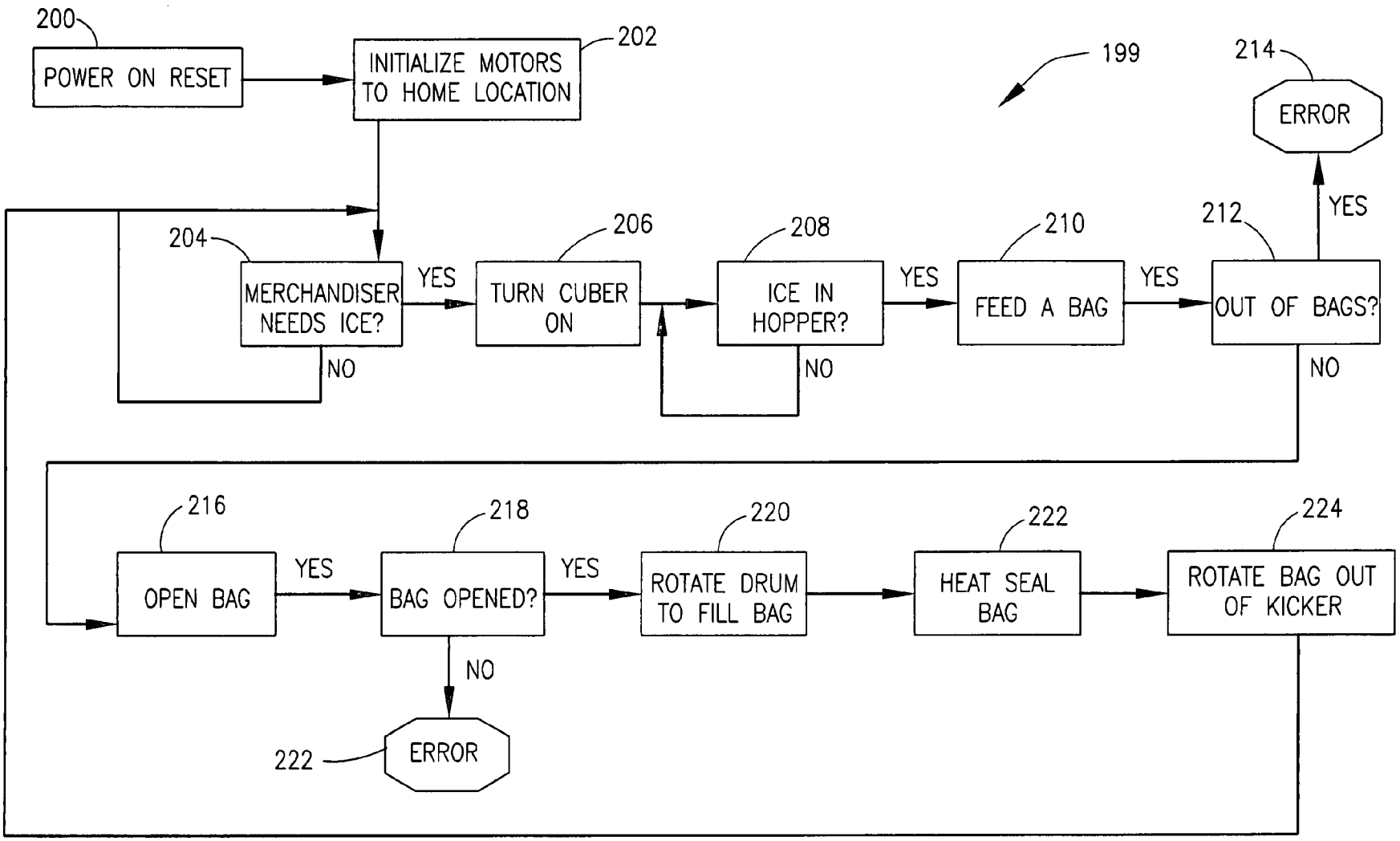
FIG. 13 is a flow chart depicting the autonomous system for producing and bagging the ice.

Referring now to FIG. 13, a flow chart depicting the most preferred embodiment of the autonomous system for producing and bagging the ice will now be described. The operator will first turn power onto the system 199, as depicted in step 200, or alternatively, the operator will reset power. This action will cause the various motors (including inner drum motor 111, stepper motor 121, basket rotator motor 124, and heat seal/cutter motor 130) in the system to initialize to the start, or home, location as set out in step 202. The system will first determine whether the merchandiser needs ice 204 via the merchandiser sensor 182 that is located within the freezer, as noted earlier. If the system determines that the merchandiser does not need ice, the system will continuously loop around polling the sensor until the merchandiser does require ice.

In the situation where the merchandiser does require ice, the system will turn the ice maker on, as seen in step 206, via the control means. The system will then inquire as to whether there is ice in the hopper (step 208) by use of the hopper sensor 102. In the event that the hopper sensor 102 indicates there is no ice in the hopper, the system will loop around again, and later poll the sensor 102.

Once the hopper sensor 102 does in fact indicate that ice is in the hopper, the system will cause the bag supply mechanism to feed a bag (step 210). The system will first determine if there are still bags on the roll (step 212). If there are no bags on the roll, the system will generate an error message (214), and wherein the error message 214 can be sent to the control means, and ultimately transmitted to a remote user via the communications module. If there are bags on the roll, the system will open the bag (step 216) via the blower fan 132, as previously described. The system will then check to determine if the bag has been opened (step 218). The bag is checked to determine if it has opened by the bag open sensor, which is a laser type sensor.

After the system receives confirmation that the bag is opened, the inner drum is rotated which in turn fills the bag, as seen in step 220. If for some reason, the system indicates that the bag did not open, an error message is generated (step 222), and wherein the error message is sent to the control means for processing and transmission.

As seen in FIG. 13, after the bag is opened (step 218) and the drum is rotated (step 220), the bag will be heat sealed 222 via the heat seal and cutter means 128 previously discussed. After being cut, the ice bag is temporarily stored in the basket, and wherein the system will then rotate the bag out of the basket as seen in step 224. At this point, the system will loop back to the step 204—and query whether the merchandiser needs ice. The process continues as previously described. Hence, the system 199 is autonomous and information collected from the various sensors and laser switches can be remotely monitored, an advantage of the present invention over the prior art.

The foregoing has been illustrative of the features and principles of the present invention. Changes and modifications in the specifically described embodiments can be carried out without departing from the scope of the invention which is intended to be limited only by the scope of the appended claims and any equivalents thereof

I claim:

1. An apparatus for bagging ice comprising:
an ice maker for making ice;
a hopper for receiving the ice from the ice maker;
a roller drum, operatively associated with the hopper, for measuring ice and delivering of the ice, wherein the roller drum comprises: an inner drum concentrically located within an outer drum, wherein the inner drum rotates relative to the outer drum; and wherein, rotations of the inner drum are counted to determine the amount of ice to be received in a bag;
a bagger, operatively receiving the ice from the roller drum, for placing the ice in a bag;
a freezer for storing the bagged ice; and
a processor for managing and monitoring the roller drum and the bagger.

2. The apparatus of claim 1 wherein the bagger includes:
a bag supply mechanism;
a blower fan engaged to open the mouth of the bag to receive the product;
a heat sealer for heat sealing the open mouth of the bag once the bag is filled with the ice.

3. The apparatus of claim 2 further comprising:
a sensor positioned within the hopper for detecting the presence of ice in the hopper, and producing information indicative thereof.

4. The apparatus of claim 3 wherein the bag includes a signal code containing identifying information and wherein the apparatus further includes:
a reader for reading the signal code on the bag from the bag supply mechanism and producing information indicative thereof.

5. The apparatus of claim 4 further comprising:
means for processing the information from the a reader and the sensor within the processor;
means for storing the information obtained from the a reader and sensor within the processor;
means for transmitting the information to a web page accessible on the Internet.

6. The apparatus of claim 1 further comprising:
at least one sensor, operatively associated with said basket, for counting the number of bags placed into the freezer and transmitting the number to the processor.

7. The apparatus of claim 6 wherein the bagger includes:
a bag supply mechanism;
a blower fan engaged to open the mouth of the bag to receive the ice;
a heat sealer for heat sealing the open mouth of the bag once the bag is filled with the ice.

8. The apparatus of claim 7 wherein the processor transmits data from the processor to a central server.

9. The apparatus of claim 8 wherein the central server is connected to the Internet so that multiple remote users can access the central server.

10. The apparatus of claim 9 wherein the freezer contains at least one laser switch for determining when the freezer is full.

11. The apparatus of claim 9 further comprising:
a reader for reading a signal code on the furnished bags from the bag supply mechanism and producing information indicative thereof, wherein the information obtained from the reader is stored within the processor.

12. The apparatus of claim 9 wherein said outer cylindrical member has a top opening and a bottom opening, and wherein said inner cylindrical member has a first opening; and wherein the drum further comprises a motor for rotating said inner cylindrical member so that the first opening of the inner cylindrical member rotates past the top opening and bottom opening of the outer cylindrical member.

13. The apparatus of claim 12 wherein said drum further comprises:

at least one sensor for counting the number of revolutions of the inner cylindrical member so that the volume of the ice delivered to the bag can be calculated.

14. A process of bagging ice with an ice bagging apparatus, the process comprising:

making ice;

channeling the ice to a hopper;

channeling the ice to a roller drum;

supplying a bag via a bag supply mechanism;

rotating the roller drum to a position over the bag once the roller drum is filled with an amount of ice;

counting the number of rotations of the roller drum;

blowing a mouth of the bag open with a blower fan;

dumping the ice into the bag;

heat sealing the bag with a heat seal strip;

automatically rotating the sealed bag into a storage unit.

15. The process of claim 14 further comprising:

placing reader to read a signal code on the furnished bags from a bag supply mechanism in the ice bagging apparatus;

reading the signal code with the reader and producing information indicative thereof;

storing the information obtained from laser switches and reader within the processor;

transmitting the information to a web page accessible on the Internet;

monitoring the information found on the web page by a remote user for ensuring production of bags, for reporting, and for regular maintenance.

16. A method of producing ice comprising:

making ice in an ice maker;

moving ice into a hopper from the ice maker;

sensing the amount of ice in the hopper via a hopper sensor;

starting the ice maker if level not full;

providing a bag feeding mechanism with a continuing strip of bags;

feeding the ice from the hopper into a drum;

feeding a first bag into position under the drum;

blowing the first bag open using a blower motor;

verifying that the first bag is opened with a bag open sensor;

rotating the drum so that the ice falls out of the drum into the bag;

measuring the amount of ice with the drum by counting the number of rotations of the drum;

heat sealing the first bag closed;

cutting the first bag; and, dispensing the first bag into a freezer.

17. The method of claim 16 further comprising:

feeding a second bag into position;

blowing the second bag open using the blower motor;

sensing that the bag did not open with the bag open sensor;

terminating the bag feed since the bag is closed.

18. The method of claim 17 further comprising:

removing power from a motor driving the rotation of the drum;

communicating that the feeding of the bags has terminated to a central server based on a scheduled call.

19. An apparatus for bagging ice comprising:

an ice maker for making ice;

a hopper for receiving the ice from the ice maker, a roller drum, operatively associated with a hopper, for measuring ice and delivering ice;

a bagger, operatively receiving the ice from the roller drum, for placing the ice in a bag from a continuous strip of bags, wherein said roller drum comprises an outer cylindrical member, and an inner cylindrical member rotatably disposed within said outer cylindrical member;

a bag separator for cutting the bag filled by the bagger;

a basket for temporary placement of the bag after the bag is cut;

a freezer for storing the bag;

a processor for managing and monitoring the roller drum and the bagger; and a basket motor for rotating the basket once the bag has been cut and is inside the basket so that the bag falls from the basket into the freezer.

20. A process of bagging ice with an ice bagging apparatus, the process comprising:

making ice in an ice maker;

channeling the ice to a hopper;

channeling the ice to a roller drum, said roller drum comprising: an outer drum, and an inner drum rotatably mounted within the outer drum, wherein the outer drum contains an upper opening and a lower opening, and wherein said inner drum contains a first opening;

supplying a bag to a rotatable basket via a bag supply mechanism having a continuous strip of bags;

rotating the inner drum relative to the outer drum so that the first opening of the inner drum is aligned with the lower opening of the outer drum so that the ice is dumped from the roller drum;

engaging a mouth of the bag with a blower fan;

blowing the bag open with the blower fan;

dumping the ice from the inner drum into the opened bag;

heat sealing the bag with a heat seal strip;

cutting the bag and allowing the sealed bag to fall into the basket;

automatically rotating the basket so that the sealed bag is delivered into a storage unit.

21. The process of claim 20 further comprising:

reading a signal code on the bag from the bag supply mechanism so that information from the bag is produced;

processing the information with a processor, said processor being located on the ice bagging apparatus;

storing the information obtained within the processor;

transmitting the information to a web page accessible on the Internet.

22. The process of claim 21 further comprising:

monitoring the information found on the web page by a remote user for ensuring production of filled bags of ice, and for reporting the number of filled bags of ice produced.

* * * * *